US011865406B2

(12) United States Patent
Hallor

(10) Patent No.: US 11,865,406 B2
(45) Date of Patent: Jan. 9, 2024

(54) POWER TRAINING APPARATUS

(71) Applicant: SPARKFIELD GMBH, Markgröningen (DE)

(72) Inventor: Mattias Hallor, Muggensturm (DE)

(73) Assignee: SPARKFIELD GMBH, Markgröningen (DE)

( * ) Notice: Subject to any disclaimer, the term of this patent is extended or adjusted under 35 U.S.C. 154(b) by 159 days.

(21) Appl. No.: 17/603,683

(22) PCT Filed: Apr. 8, 2020

(86) PCT No.: PCT/EP2020/060019
§ 371 (c)(1),
(2) Date: Oct. 14, 2021

(87) PCT Pub. No.: WO2020/212223
PCT Pub. Date: Oct. 22, 2020

(65) Prior Publication Data

US 2022/0193489 A1 Jun. 23, 2022

(30) Foreign Application Priority Data

Apr. 18, 2019 (DE) ..... 10 2019 205 676.8

(51) Int. Cl.
*A63B 23/035* (2006.01)
*A63B 21/00* (2006.01)

(52) U.S. Cl.
CPC ..... *A63B 23/03566* (2013.01); *A63B 21/159* (2013.01); *A63B 21/4034* (2015.10); *A63B 21/4035* (2015.10); *A63B 2225/102* (2013.01)

(58) Field of Classification Search
CPC ..... A63B 21/005; A63B 21/0051; A63B 21/0052; A63B 21/0056; A63B 21/0057;
(Continued)

(56) References Cited

U.S. PATENT DOCUMENTS 5,362,297 A 11/1994 Muir
5,707,321 A 1/1998 Maresh
(Continued)

FOREIGN PATENT DOCUMENTS

CN 203400456 U 1/2014
CN 205516417 U 8/2016
(Continued)

OTHER PUBLICATIONS

International search report for patent application No. PCT/EP2020/060019 dated Jun. 12, 2020.

*Primary Examiner* — Gary D Urbiel Goldner
(74) *Attorney, Agent, or Firm* — Bachman & LaPointe, P.C.

(57) ABSTRACT

The invention relates to a power training apparatus (10) with a manually actuatable operating element (30) which is coupled via a lever mechanism (20) to at least one unit (39, 41, 42) generating a resistance, wherein the lever mechanism (20) has, at a distance from a grip element (32) of the operating element (30), at least one first joint (26) which is mounted in a first axle (21) via at least one first joint lever (25), and having at least one second joint (35) which is arranged between the at least one first joint (26) and the grip element (32), wherein the at least one second joint (35) is mounted at least indirectly in a second axle (22) via at least one second joint lever (36), wherein one of the axles (21, 22) is operatively connected to the at least one unit (39, 41, 42), and wherein the other of the two axles (21, 22) is blocked or is pivotable about a small angle.

10 Claims, 5 Drawing Sheets

(58) Field of Classification Search
CPC ... A63B 21/0058; A63B 21/15; A63B 21/159; A63B 21/4033; A63B 21/4034; A63B 21/4035; A63B 21/4047; A63B 23/0205; A63B 23/0211; A63B 23/0233; A63B 23/0238; A63B 23/035; A63B 23/03516; A63B 23/03525; A63B 23/0355; A63B 23/03558; A63B 23/03566; A63B 23/04; A63B 23/0482; A63B 23/0494; A63B 23/12; A63B 23/1209; A63B 23/1218; A63B 2208/0228; A63B 2208/0233; A63B 2225/10; A63B 2225/102
See application file for complete search history.

(56) References Cited

U.S. PATENT DOCUMENTS

| | | | | |
|---|---|---|---|---|
| 5,967,944 | A | 10/1999 | Vittone et al. | |
| 5,989,165 | A * | 11/1999 | Giannelli | A63B 23/03533 482/136 |
| 6,071,216 | A * | 6/2000 | Giannelli | A63B 21/4035 482/136 |
| 6,074,328 | A * | 6/2000 | Johnson | A63B 21/4035 482/137 |
| 6,254,516 | B1 * | 7/2001 | Giannelli | A63B 23/1209 482/136 |
| 2011/0275497 | A1 * | 11/2011 | Lorusso | A63B 23/0405 482/139 |
| 2015/0072835 | A1 | 3/2015 | Kunstmann | |
| 2015/0141207 | A1 | 5/2015 | Eschenbach | |
| 2017/0340503 | A1 | 11/2017 | Turner | |

FOREIGN PATENT DOCUMENTS

| | | | |
|---|---|---|---|
| CN | 108744423 | A | 11/2018 |
| EP | 2389989 | A2 | 11/2011 |
| WO | 8000124 | A1 | 2/1980 |
| WO | 2007/122397 | A1 | 11/2007 |
| WO | 2018001839 | A1 | 1/2018 |
| WO | 2018195344 | A1 | 10/2018 |

* cited by examiner

POWER TRAINING APPARATUS

BACKGROUND OF THE INVENTION

The invention relates to a strength training apparatus as it is used for strengthening the muscles in the upper part of the body and/or the leg or core muscles of a person exercising. For example, the strength training apparatus can be used both in gyms and at home or in other environments.

In the context of an apparatus body for a strength training apparatus, a strength training apparatus has become known from WO 2018/010839 A1 which is characterized in that it can be used for different purposes, i.e., for the training of different body muscle groups, as a result of an optional arrangement of axes inside the apparatus body. For example, such strength training apparatuses serve to strengthen the chest or shoulder muscles and are realized in the form of a so-called chest press or of a so-called shoulder press. For example, a strength training apparatus in the form of a chest press of the company eGym has become known by the name "M5"; (https://egym.com/de/fitnessgeraete/brustpresse/).

Such strength training apparatuses known from the state of the art are characterized in that they are substantially designed or suitable only for the training of a specific muscle group. If several muscle groups are to be trained, a separate strength training apparatus is required for each muscle group.

SUMMARY OF THE INVENTION

The strength training apparatus according to the invention having the features disclosed herein has the advantage that it is at least suitable for the optional training of at least two different muscle groups. It is thus not necessary to use a separate strength training apparatus for each of the muscle groups. In particular, the strength training apparatus according to the invention is intended to replace two training apparatuses which are realized in the form of a chest press and a shoulder press, respectively.

The invention is based on the idea that as a result of a lever mechanism modified compared to the state of the art, said lever mechanism can optionally be used for the training of different muscle groups. In this context, it has been found that the modification required for this purpose can be designed in a relatively simple manner, the costs or the (additional) design effort for the strength training apparatus according to the invention thus being relatively low compared to a strength training apparatus which merely serves to train a single muscle group.

Against this background, the teaching of the invention as disclosed herein proposes to modify a strength training apparatus known from the state of the art in that the at least one second joint lever of the lever mechanism is connected to the second axis via a coupling link, and in that the two axes can each be locked individually and can individually be operatively connected to the at least one unit generating the resistance to the displacement of the axis. In other words, this means that as a result of the locking of the one or the other axis, the operating or handle element which can be operated manually by the person exercising can be displaced in a different manner, which allows the training of the different muscle groups in the intended manner.

Advantageous embodiments of the strength training apparatus according to the invention are also disclosed herein and in the dependent claims.

To allow a particularly compact design of the lever mechanism, an embodiment of the strength training apparatus preferred in terms of construction provides that the at least two joint levers are disposed on the same side of a rod of the operating element (i.e., for example, in the direction of a base of the strength training apparatus).

As already indicated above, the alternate locking of the one or the other axis of the lever mechanism allows the training of different muscle groups. The training of the different muscle groups typically requires the person exercising to move the operating or handle element in different ways. For this reason, another embodiment of the invention proposes that the handle element is disposed so as to be pivotable about the second joint when the first axis is locked, and that the handle element is disposed so as to be displaceable in an approximately linear direction when the second axis is locked. These two different types of movement of the handle element have the effect that as with a chest press or a shoulder press, the corresponding muscle groups can be trained in a separate and targeted manner.

In the context of the structural arrangement of the individual elements of the joint mechanism, the invention provides that the coupling link is selectively disposed either on the side facing away from the first axis or on the side facing the first axis when the first axis is locked, and that the coupling link is disposed on the side facing the first axis when the second axis is locked. In this way, the pivoting of the handle element as well as its linear motion can be realized in a particularly simple manner.

To introduce or transfer the corresponding resistance to the motion of the person exercising into or to the respective axis which is not locked, a first structural embodiment provides that the two axes are each connected to a separate unit (as a resistance resource). Such a structural configuration has the advantage that no coupling device or similar elements have to be provided to be able to establish an alternate operative connection between a single unit and the two different axes if a single unit is provided.

As a structural design alternative to this proposal, another embodiment can provide that the two axes are connected to a shared unit (as a resistance resource) which can be coupled to the first or the second axis via a coupling device.

To be able to use the strength training apparatus described above for the training of more than two different muscle groups, another advantageous embodiment of the invention provides that at least one axis operatively connected to an additional unit generating a resistance is provided, said axis being connected to an additional operating element via an additional joint lever, and that a neutral position of the axis can be set in at least two different angle positions of the additional joint lever. For example, such an embodiment of the strength training apparatus allows the training of both the thigh muscles and the abdominal muscles or the back muscles according to the different neutral positions of the joint levers.

In order, for example, to be able to place the strength training apparatus in a corner of a room and still be able to train all the muscle groups that can be strained by the strength training apparatus, another embodiment of the strength training apparatus provides that the axes coupled to the resistance or units extend parallel to one another.

The training of the shoulder or chest muscles mentioned as an example and of the back or abdominal muscles typically requires different types of seating or positions of the person exercising. Another preferred embodiment of the strength training apparatus, which even allows the simultaneous use of the strength training apparatus by two different persons exercising, as it is typically conceivable in a gym, provides that the operating element and the additional operating element are disposed parallel and laterally offset to one another.

Last, a preferred embodiment of the strength training apparatus has a housing in which at least the units generating the resistance are disposed inside the housing, and wherein the operating element is aligned with a symmetry plane of the housing outside the housing. In this way, overturning moments or the like on the strength training apparatus are minimized during the introduction of forces or torques into the operating elements.

Further advantages, features and details of the invention are apparent from the following description of preferred exemplary embodiments and from the drawings.

DETAILED DESCRIPTION

Figure 1:
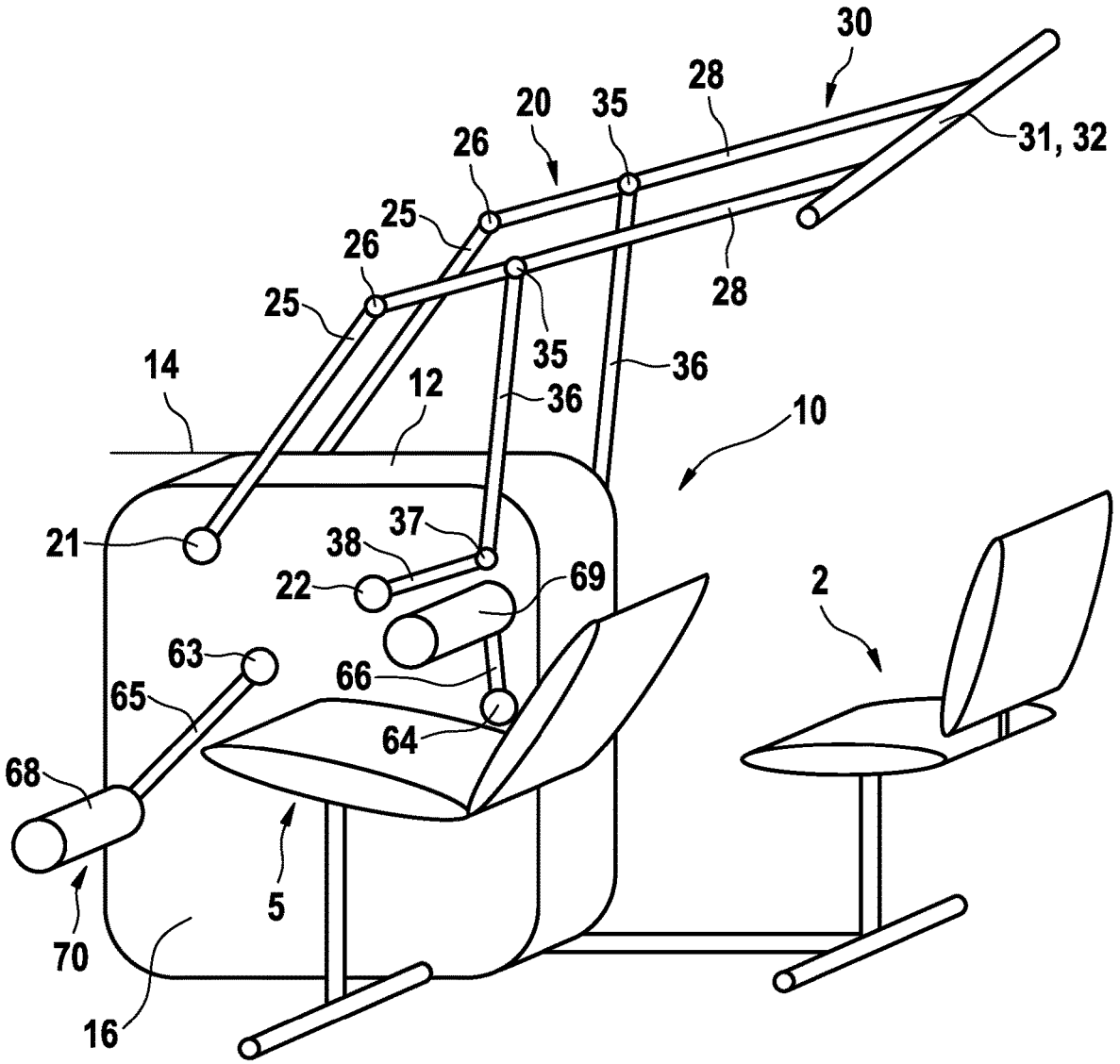
FIG. 1 shows a perspective illustration of a strength training apparatus according to the invention for the training of different muscle groups.

In the figures, the same elements and elements having the same function are referenced with the same reference numerals.

FIG. 1 shows a multifunctional strength training apparatus 10 which is configured to be able to perform different exercises for the training of different muscle groups of a person exercising 1. Strength training apparatus 10 comprises a housing 12 which has a symmetry plane 14 which extends parallel to the two lateral walls 16 of housing 12. According to the illustration of FIGS. 1 to 5, strength training apparatus 10 has a lever mechanism 20 which serves to strengthen both the chest muscles and the muscles of the shoulder and the upper back of a person exercising 1 (merely shown in a symbolic manner in FIGS. 4 to 9). To this end, lever mechanism 20 comprises a first axis 21 and a second axis 22 which are disposed parallel to one another, wherein, according to the illustration of FIG. 1, first axis 21 is disposed (slightly) above second axis 22 on housing 12.

First axis 22 is connected to a first joint lever 25 on either side outside housing 12 in a symmetrical manner in relation to symmetry plane 14, the connection between each first joint lever 25 and first axis 21 being realized in a non-rotatable or rigid manner. The two first joint levers 25 are each coupled to a first joint 26 on the side of first joint lever 25 facing away from first axis 21. Moreover, the two first joints 26 are coupled to two rods 28 of an operating element 30 which are disposed parallel to one another. In this way, rods 28 are each disposed so as to be pivotable in relation to first joint lever 25 in the area of first joint 26. On the side of rods 28 facing away from first joint 26, rods 28 are connected to a shared element 31 which extends transverse to the direction of the two rods 28 and which is used as a handle element 32 via which person exercising 1 can move lever mechanism 20. Alternatively, operating element 30 can have two or more separate handle elements 32.

In an area between first joint 26 and handle element 32, a second joint 35 is disposed in the area of each of the two rods 28, a second joint lever 36 being fixed via second joint 35 so as to be pivotable. On the side of each second joint lever 36 facing away from second joint 35, a coupling link 38, which is rod-shaped as an example, is connected to second joint lever 36 via a third joint 37 so as to be pivotable on one side and to second axis 22 in a non-rotatable manner on the other side.

The two axes 21, 22 of strength training apparatus 10 are alternately disposed either in such a manner that they are displaceable or rotatable or in such a manner that they are lockable or rigid or, as an alternative to the lockable or rigid configuration, in such a manner that they are pivotable about a small angle. With respect to FIG. 2, it is illustrated in connection with a first embodiment that first axis 21 is disposed in operative connection with or operatively connected to a first unit 41 and that second axis 22 is disposed in operative connection with or operatively connected to a second unit 42. The two units 41, 42 are realized as electromotive components in the form of a permanently excited synchronous motor, for example, and serve to offer resistance when person exercising 1 rotates axes 21, 22 by moving lever mechanism 20; person exercising 1 must exert a force or a torque against said resistance in order to cause a rotation of first axis 21 or of second axis 22. Furthermore, the two axes 21, 22 are each connected to a locking device 43, 44 which, instead of acting as a lock, may also allow a rotation about a small angle, such as a maximum angle of 30°, of corresponding axis 21, 22.

Figure 3:
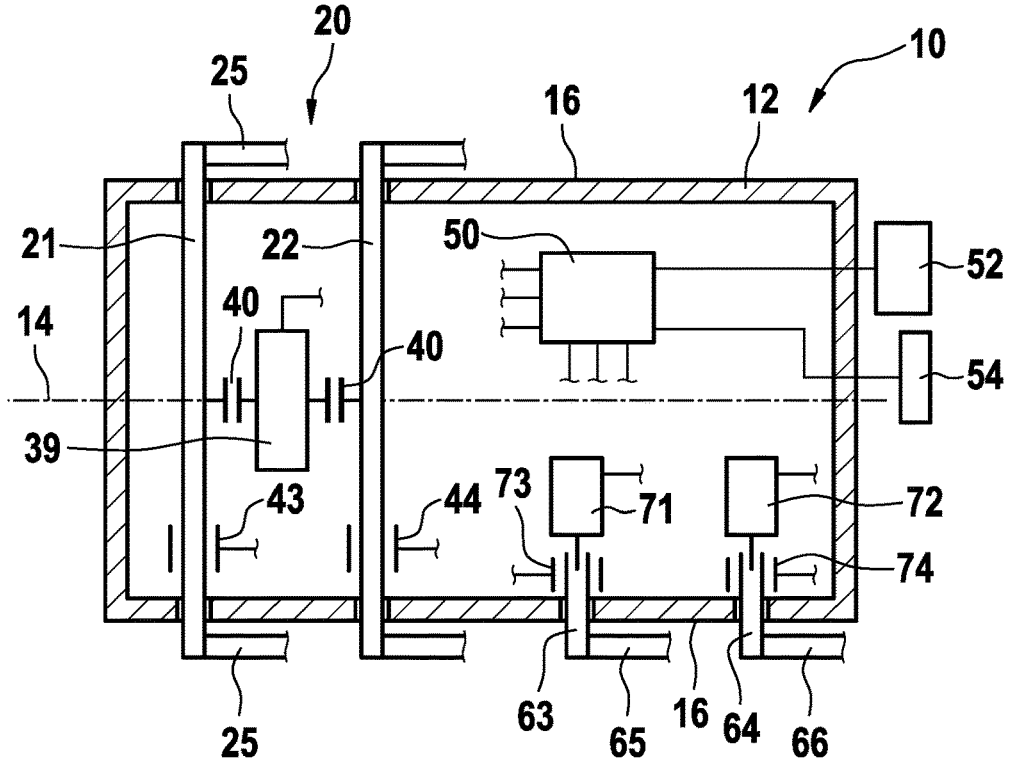

By contrast, FIG. 3 shows the case in which the two axes 21, 22 are connected to a shared unit 39 via alternately switchable coupling devices 40.

Purely by way of example, the control of units 39, 41, 42 and of the two locking devices 43, 44 is performed via a shared control device 50. Also by way of example, control device 50 is connected to an input unit 52 (shown only in FIGS. 2 and 3) and to a display 54. Person exercising 1 can select different programs or levels of resistance of the two axes 21, 22 or of units 39, 41, 42 via input unit 52. The settings, as well as the correct performance of the movements of person exercising 1, can be displayed via display 54, for example. To this end, the embodiment also provides that units 39, 41, 42 or the two axes 21, 22 are connected to corresponding sensor devices for detecting the rotation angle velocity or rotation or the position.

Figure 2:
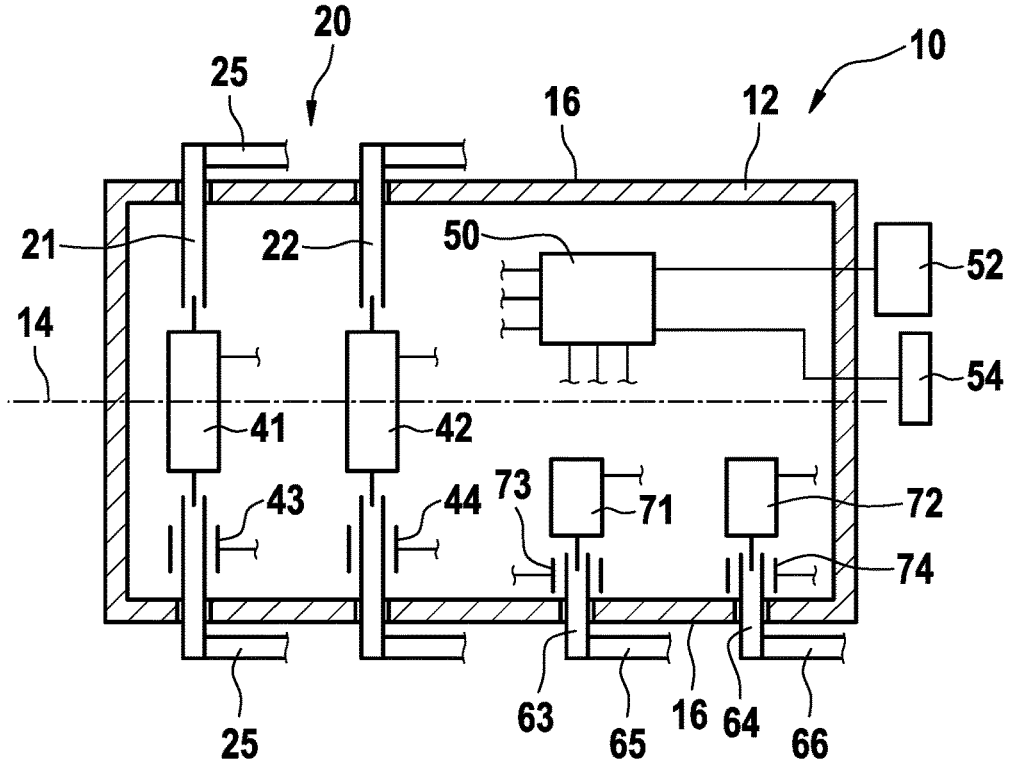
FIGS. 2 and 3 show a simplified section of the housing of the strength training apparatus according to FIG. 1 for illustrating different arrangements of the units for the lever mechanism, which are coupled to the axes.

The essential aspect of the embodiment according to FIG. 2 is that second axis 22 is simultaneously locked by means of corresponding locking device 44 when first unit 41 or first axis 21 is activated. Conversely, first axis 21 is locked via an activation of locking device 43 when second axis 22 or second unit 42 is activated.

Figure 4D:
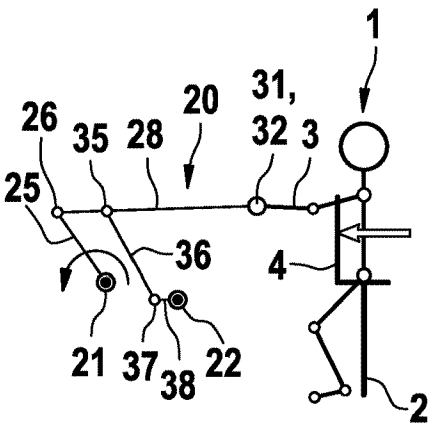
FIG. 4*d* shows an illustration for explaining another type of motion for the training of the back muscles by means of the strength training apparatus.
Figure 4C:
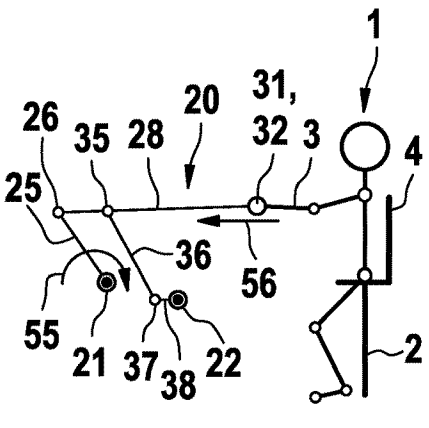
FIGS. 4*a* to 4*c* show the process during the training of the chest muscles by means of the strength training apparatus.
Figure 4B:
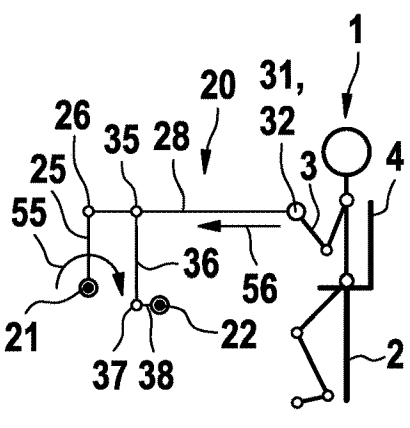
Figure 4A:
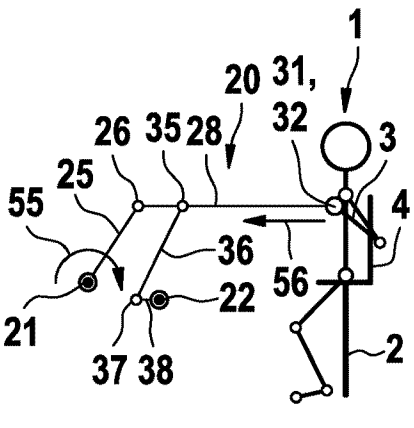

With reference to the sequence of FIGS. 4*a* to 4*c*, the functioning of lever mechanism 20 for the training of different muscle groups is explained on the basis of a so-called chest press, which serves to strengthen the chest muscles of person exercising 1. Here, person exercising 1 sits on a seat 2, which is in particular disposed so as to be height-adjustable. Starting from FIG. 4*a*, person exercising 1 extends his/her arms 3 from a position near his/her chest in such a manner that, according to FIG. 4*c*, arms 3 are at least approximately in the outstretched state. During this process, person exercising 1 is holding on to handle element 32 of first lever mechanism 20 with his/her hands. The sequence of FIGS. 4*a* to 4*c* shows that second axis 22 is locked while first axis 21 offers resistance to the movement of person exercising 1 via first unit 41, the resistance running counter-clockwise in the direction of arrow 55. Said sequence of figures also shows that the two rods 28 or handle element 32 are displaced in an at least approximately horizontal direction according to arrow 56 during the training.

Additionally, it is mentioned that FIG. 4*d* shows the state in which person exercising 1 performs a rowing motion in which handle element 32 is pulled from a position away from person exercising 1 toward person exercising 1. In this case, accordingly displaceable seat 2 or its seatback 4 serves in particular to support the chest of person exercising 1. Furthermore, a resistance to first axis 21 is generated in the direction opposite to arrow 56, i.e., counter-clockwise, by first unit 41.

Figure 5D:
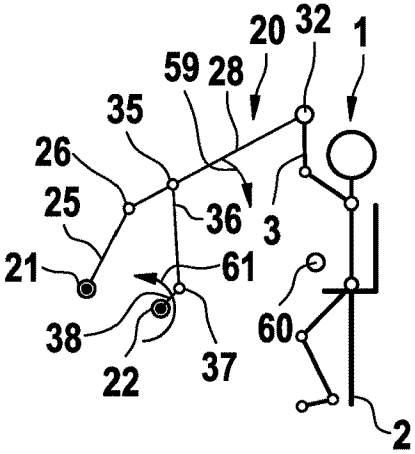
FIG. 5*d* shows an illustration for explaining another type of motion for the training of the upper back muscles by means of the strength training apparatus.
Figure 5C:
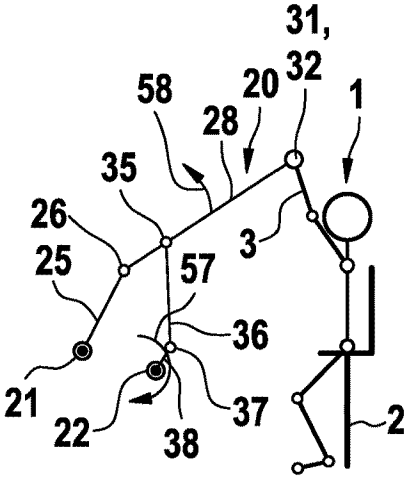
FIGS. 5*a* to 5*c* show the process of the training of the shoulder muscles by means of the strength training apparatus.
Figure 5B:
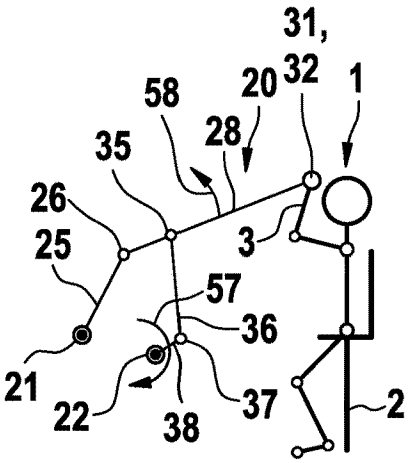
Figure 5A:
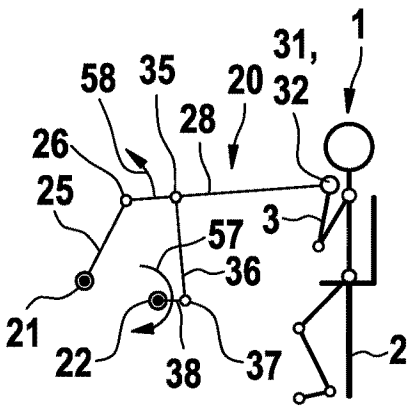

In FIGS. 5*a* to 5*d* on the other hand, strength training apparatus 10 is used for the training of the shoulder muscles of person exercising 1. To this end, first axis 21 is locked via locking device 43, whereas second axis 22 is disposed in operative connection with second unit 42. FIGS. 5*a* to 5*c* show the case in which person exercising 1 pushes handle element 32 upwards from a position which is approximately at shoulder height. In this process, the two rods 28 move around first joint 26 in the direction of arrow 58. A resistance is provided clockwise in the direction of arrow 57 via second unit 42 or second axis 22; when person exercising 1 lifts his/her arms 3, he/she must exert a force against said resistance.

FIG. 5*d* shows the case in which person exercising 1 has to pull operating element 30 from a pivoted or raised position downwards in the direction of arrow 59 in order to strengthen his/her upper back muscles. To this end, the thigh area of person exercising 1 can be fixed by means of a support element 60 in the form of support roller, for example. In this case, too, first axis 21 is locked and second axis 22 is disposed in operative connection with second unit 42, second unit 42 generating a counter-clockwise resistance, according to the direction of arrow 61, to the lowering of operating element 30 by person exercising 1.

Furthermore, strength training apparatus 10 optionally has a third axis 63 and a fourth axis 64 which extend parallel to the two axes 21, 22 and which are disposed below the two axes 21, 22 on housing 12 according to the illustration of FIG. 1. The two axes 63, 64, which are spaced apart from one another, protrude from the same lateral wall 16 of housing 12 and are connected there in a non-rotatable manner to a third joint lever 65 and to a fourth joint lever 66, respectively. Parallel to axes 63, 64, joint levers 65, 66 are each connected to a pressure roller 68, 69 on the side facing away from axes 63, 64, pressure rollers 68, 69 acting as operating elements and extending over the entire width of an additional seat 5. Additional seat 5, as well as seat 2, is disposed so as to be at least height-adjustable and is located on the side of housing 12 and laterally offset to seat 2.

By way of example, the two axes 63, 64 are each coupled to a separate third and fourth unit 71, 72 (by analogy with units 41, 42) and to a locking device 73, 74 according to FIGS. 2 and 3. Also purely by way of example, units 71, 72 and locking devices 73, 74 can be controlled by control device 50. Additionally, measurement means present accordingly for the detection of the position and/or of the rotation angle velocity of the third and the fourth axis 63, 64 are provided (not shown).

Figure 6:
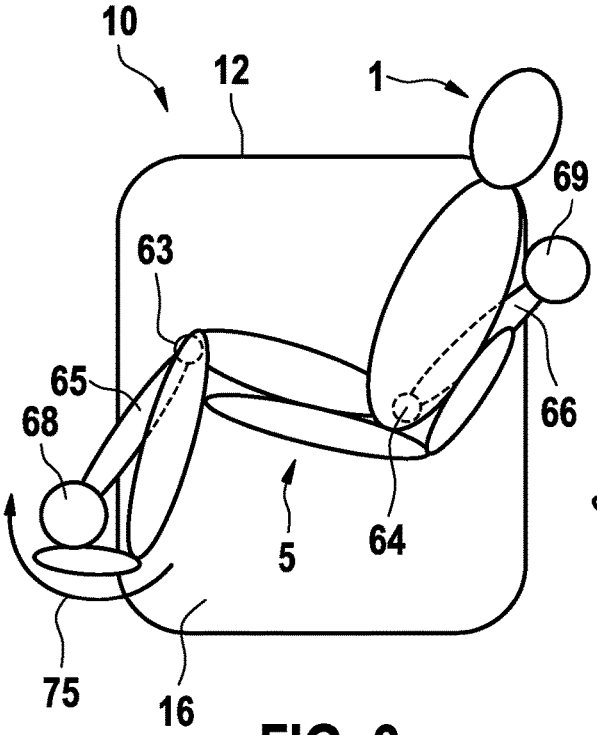
FIGS. 6 and 7 show illustrations for clarifying the training of the thigh muscles by means of the strength training apparatus.
Figure 7:
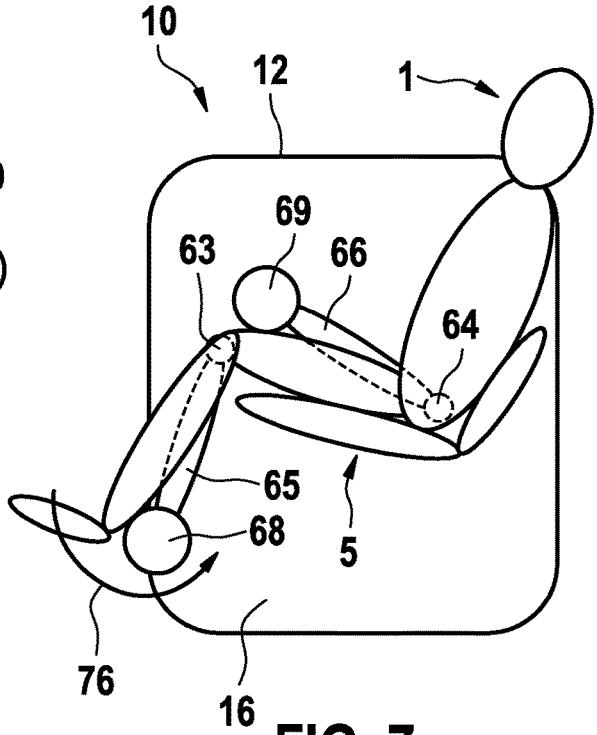

According to the illustration of FIGS. 6 and 7, third unit 71 or pressure roller 68 of a first angle position of third joint lever 65 in combination with an adapted position of an additional seat 5 can serve to strengthen the thigh muscles of person exercising 1. FIG. 6 shows the case in which the feet of person exercising 1 are in contact with pressure roller 68 in such a manner that he/she has to move third joint lever 65 from a neutral position counter-clockwise around third axis 63 according to the direction of arrow 75, third unit 71 offering resistance to said movement direction. In this situation, fourth unit 72 is inactive and pressure roller 69 is in a position which does not hinder person exercising 1 from moving pressure roller 65.

By contrast, FIG. 7 shows the case in which person exercising 1 has to move third joint lever 65 or pressure roller 68 clockwise from a neutral position according to the direction of arrow 76 by means of his/her feet or legs, third unit 71 also generating a resistance to said movement. In this exercise, pressure roller 69 may be locked in a position which prevents the thighs of person exercising 1 from lifting from seat 5.

Figure 8:
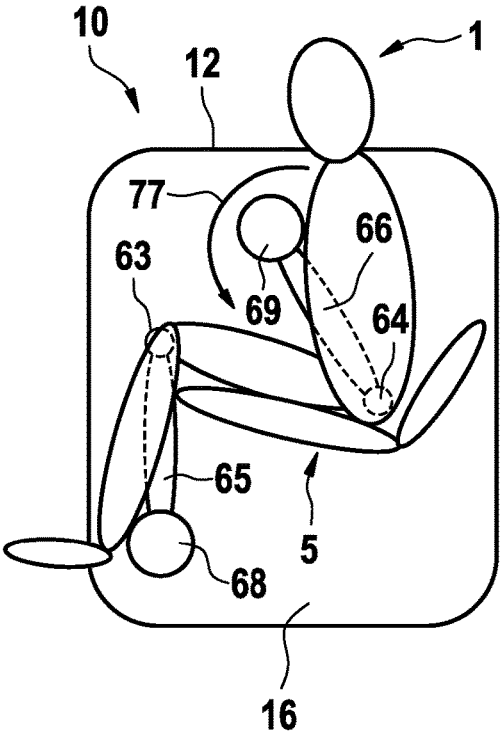
FIGS. 8 and 9 show illustrations for clarifying the training of the back and abdominal muscles by means of the strength training apparatus.
Figure 9:
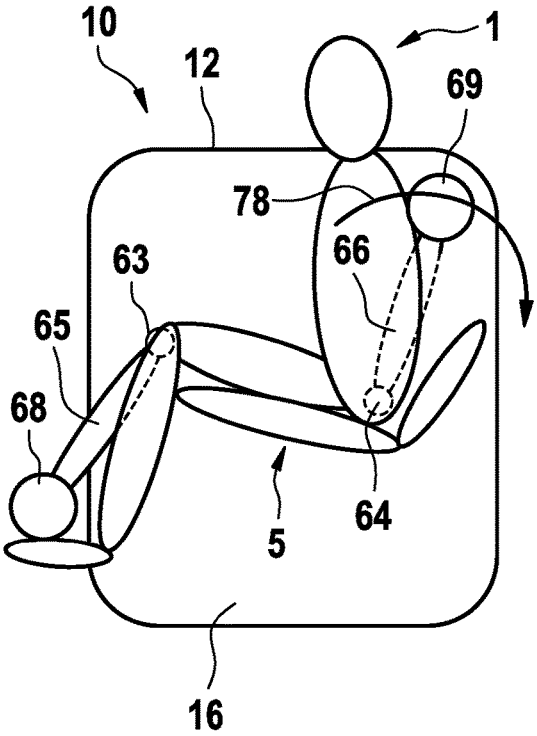

Last, FIGS. 8 and 9 show exercises for strengthening the abdominal muscles and the back muscles of person exercising 1, respectively. In these figures, fourth unit 72 is activated and third unit 71 is in a passive or locked state in order to serve as a support for the legs or feet of person exercising 1. In FIG. 8, person exercising 1 has to move pressure roller 69 counter-clockwise from its neutral position according to arrow 77 by means of his/her upper body. In FIG. 9 on the other hand, person exercising 1 has to move pressure roller 69 clockwise in the direction of arrow 78 by means of his/her back.

Additionally, it is mentioned that the laterally offset arrangement of the two seats 2 and 5 also allows the simultaneous use of strength training apparatus 10 by two persons exercising 1. To this end, accordingly modified control devices 50 or input units 52 and displays 54 may be required.

Since the upper body training and the lower body training does not have to be performed at the same time, it is also possible to use the same units/drives 41, 42 for axes 21, 22 and for axes 63, 64. To this end, units 41, 42 can be combined with specific gear designs which then couple axes 63, 64 to the mechanical resistance generated by units 41, 42. For example, a Geneva drive or a star wheel mechanism can be used as the gear design. In this case, the resistance (the braking torque) is selectively transferred from units 41, 42 to axes 21, 22 and/or to axes 63, 64. In particular up to four axes 21, 22, 63, 64 can thus be coupled to a single unit 41 or to a total of exactly two units 41, 42 in order to transfer a mechanical resistance or a braking torque.

Strength training apparatus 10 described above can be adapted or modified in many ways without departing from the idea of the invention.

The invention claimed is:

1. A strength training apparatus (10) having a manually operable operating element (30) coupled via a lever mechanism (20) to at least one unit (39, 41, 42) generating a resistance, the lever mechanism (20) having, at a distance from a handle element (32) of the operating element (30), at least one first joint (26) mounted in a first axis (21) via at least one first joint lever (25), and the lever mechanism (20) having at least one second joint (35) disposed between the at least one first joint (26) and the handle element (32), the at least one second joint (35) being mounted at least indirectly in a second axis (22) via at least one second joint lever (36), one of the first and second axes (21, 22) being disposed in operative connection with the at least one unit (39, 41, 42), the other of the first and second axes (21, 22) being locked or being pivotable about a small angle, wherein the at least one second joint lever (36) being connected to the second axis (22) via a coupling link (38), wherein the first and second axes (21, 22) each being lockable or pivotable about the small angle individually and being operatively connectable to the at least one unit (39, 41, 42) individually, wherein the at least one first joint lever (25) and the at least one second joint lever (36) being disposed on a same side of a corresponding one of at least one rods (28) of the operating element (30), wherein the at least one second joint (35) being coupled to the corresponding one of the at least one rods (28) at a location between the at least one first joint (26) and the handle element (32), the at least one second joint lever (36) being fixed at a first end thereof via the at least one second joint (35) so as to be pivotable at the at least one second joint (35), and wherein, at an opposite second end of the at least one second joint lever (36) facing away from the at least one second joint (35), the coupling link (38) being connected to the at least one second joint lever (36) via a third joint (37) so as to be pivotable on a first end of the coupling link (38) and non-rotatably coupled to the second axis (22) on an opposite second end of the coupling link (38).

2. The strength training apparatus according to claim 1, wherein two first joints are provided which are respectively coupled to two rods (28) of the operating element (30).

3. The strength training apparatus according to claim 1, wherein the handle element (32) is disposed so as to be pivotable about the at least one first joint (26) when the first axis (21) is locked, and wherein the handle element (32) is disposed so as to be displaceable in an approximately linear direction when the second axis (22) is locked.

4. The strength training apparatus according to claim 3, wherein the coupling link (38) faces away from the first axis (21) when the first axis (21) is locked, and wherein the coupling link (38) faces the first axis (21) when the second axis (22) is locked.

5. The strength training apparatus according to claim 1, wherein the first and second axes (21, 22) are each connected to a separate unit (41, 42) of the at least one unit (39, 41, 42).

6. The strength training apparatus according to claim 1, wherein the first and second axes (21, 22) are connected to one shared unit (39) of the at least one unit (39, 41, 42) which can be coupled to the first or the second axis (21, 22) via a coupling device (40).

7. The strength training apparatus according to claim 1, wherein at least one additional axis (63, 64) distinct from the first and second axes (21, 22) is provided which is operatively and respectively connected to an additional unit (71, 72) generating a resistance and an additional operating element (68, 69) via an additional joint lever (65, 66), and wherein a neutral position of the axis (63, 64) can be respectively set in at least two different angle positions of the additional joint lever (65, 66).

8. The strength training apparatus according to claim 7, wherein the first and second axes (21, 22) and the at least one additional axis (63, 64) extend parallel to one another.

9. The strength training apparatus according to claim 7, wherein the operating element (30) and the additional operating element (68, 69) are disposed parallel and laterally offset to one another.

10. The strength training apparatus according to claim 1, further comprising two additional units (71, 72) generating a resistance, wherein the at least one unit (39, 41, 42) comprises three units (39, 41, 42) wherein two of the three units (41, 42) and the two additional units (71, 72) are disposed inside a housing (12), and wherein the operating element (30) is aligned with a symmetry plane (14) of the housing (12) outside the housing (12).

* * * * *